US008011938B2

(12) United States Patent
Martin et al.

(10) Patent No.: US 8,011,938 B2
(45) Date of Patent: Sep. 6, 2011

(54) ELECTRICAL CONNECTOR HAVING LINEAR ACTUATOR

(75) Inventors: Galen M Martin, Camp Hill, PA (US); John Raymond Shuey, Mechanicsburg, PA (US); James Gundermann, Palmyra, PA (US)

(73) Assignee: Tyco Electroniccs Corporation, Berwyn, PA (US)

( * ) Notice: Subject to any disclaimer, the term of this patent is extended or adjusted under 35 U.S.C. 154(b) by 0 days.

(21) Appl. No.: 12/454,607

(22) Filed: May 20, 2009

(65) Prior Publication Data

US 2009/0291583 A1 Nov. 26, 2009

Related U.S. Application Data

(60) Provisional application No. 61/128,461, filed on May 21, 2008.

(51) Int. Cl.
*H01R 13/62* (2006.01)

(52) U.S. Cl. ..... 439/157; 439/159

(58) Field of Classification Search ..... 439/157, 439/159

See application file for complete search history.

(56) References Cited

U.S. PATENT DOCUMENTS

| | | | | |
|---|---|---|---|---|
| 5,489,224 | A * | 2/1996 | Schwarz | 439/752 |
| 6,155,850 | A | 12/2000 | Martin et al. | |
| 6,371,778 | B1 * | 4/2002 | Watanabe | 439/157 |
| 6,612,854 | B2 * | 9/2003 | Takata | 439/157 |
| 6,638,085 | B1 * | 10/2003 | Martin | 439/157 |
| 6,644,991 | B2 * | 11/2003 | Martin | 439/157 |
| 6,652,298 | B2 * | 11/2003 | Ohnuki | 439/157 |
| 6,854,992 | B2 * | 2/2005 | Martin et al. | 439/157 |
| 6,881,081 | B2 * | 4/2005 | Gundermann et al. | 439/157 |
| 6,997,725 | B2 * | 2/2006 | Stella et al. | 439/157 |
| 7,238,050 | B2 * | 7/2007 | Sakakura et al. | 439/607.52 |
| 7,241,155 | B2 * | 7/2007 | Tyler et al. | 439/157 |
| 7,255,580 | B2 | 8/2007 | Foltz et al. | |
| 7,462,047 | B2 | 12/2008 | Tyler | |
| 7,611,365 | B1 * | 11/2009 | Ng et al. | 439/157 |

* cited by examiner

*Primary Examiner* — Truc Nguyen

(57) ABSTRACT

An electrical connector assembly is shown having a housing member with a mating assist which rotatably draws complementary connectors together. The mating assist is actuated by way of a linear actuator which rotates the mating assist member.

16 Claims, 15 Drawing Sheets

ELECTRICAL CONNECTOR HAVING LINEAR ACTUATOR

RELATED APPLICATION

This application claims priority from Provisional patent application Ser. No. 61/128,461 filed May 21, 2008.

FIELD OF THE INVENTION

The subject application relates to electrical connectors and more importantly to electrical connectors having a mating assist feature to draw complementary connectors together.

In certain applications, electrical connectors must be securely mated to one another to prevent disconnection of the electrical signals routed through the connector conductors. In those same applications, it is desirable that the connectors be fully mated.

For example, in automotive applications where electrical signals are routed to safety equipment such as air bag deployment systems or other systems relating to the operational or safety features of the vehicle, disconnection of the electrical signals as a result of accident, negligence, or operating conditions such as vibration, etc. may result in undesirable consequences. These connectors systems further require assistance in mating, as multiple pairs of contacts are being connected. Thus, the mating force can be too high for the operator or mechanic in the case of automotive applications, to accomplish by hand. Thus, a mating assist member is normally desired, if not required.

Some mating assist members, include a rotatable lever, where the lever has gear teeth, which mesh with complementary gear teeth on a mating connector, such that rotation of the lever, causes the gear teeth associated with the lever to draw the mating connector into electrical connection, see for example our U.S. Pat. No. 7,255,580. Other connector styles include a camming slide type arrangement, see for example our U.S. Pat. No. 6,155,850 where the slide includes camming slots which interact with a cam lug on one of the connectors, where the slide causes the camming lugs to follow the camming slots and draw the mating connector into electrical connection.

While these connectors have significant utility in the market place, one of their shortcomings is the need for space at least in the adjacent vicinity of the connectors, for actuation of either the lever or the slide, and the need for the space for one's hand in order to operate the connectors.

SUMMARY OF THE INVENTION

In a first embodiment, an electrical connector assembly comprises an electrical connector assembly comprising a housing having a front mating face for mating with a mating connector along a mating axis. The housing has at least one terminal receiving cavity extending therethrough, and the housing has a mating assist member operatively connected to the housing. An actuator member causes movement of the mating assist member, upon movement of the actuator member along the mating axis relative to the housing.

In another embodiment, an electrical connector assembly comprises a housing having a front mating face for mating with a mating connector along a mating axis, the housing having at least one terminal receiving cavity extending therethrough. The housing has a mating assist member operatively connected to the housing, where the mating assist member includes at least one gear tooth. An actuator member is movable relative to the housing along the mating axis, and is cooperable with the mating assist member, thereby moving the at least one gear tooth upon movement of the actuator member.

DETAILED DESCRIPTION OF THE PREFERRED EMBODIMENT

Figure 2:
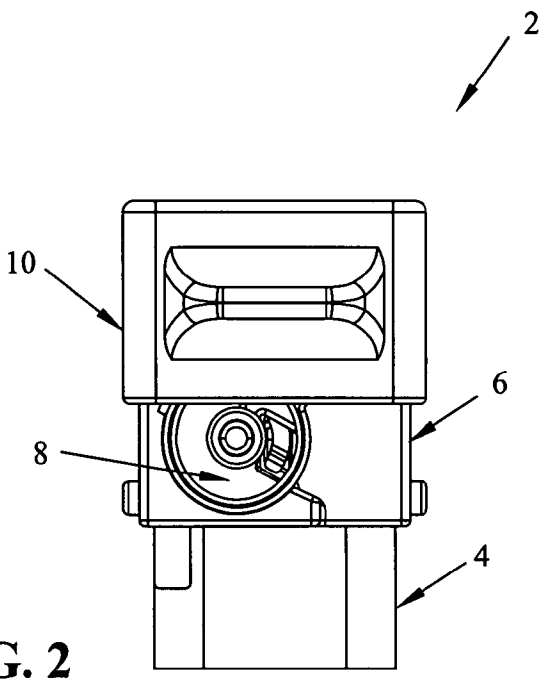
FIG. 2 is a top plan view of the connector assembly of FIG. 1.
Figure 1:
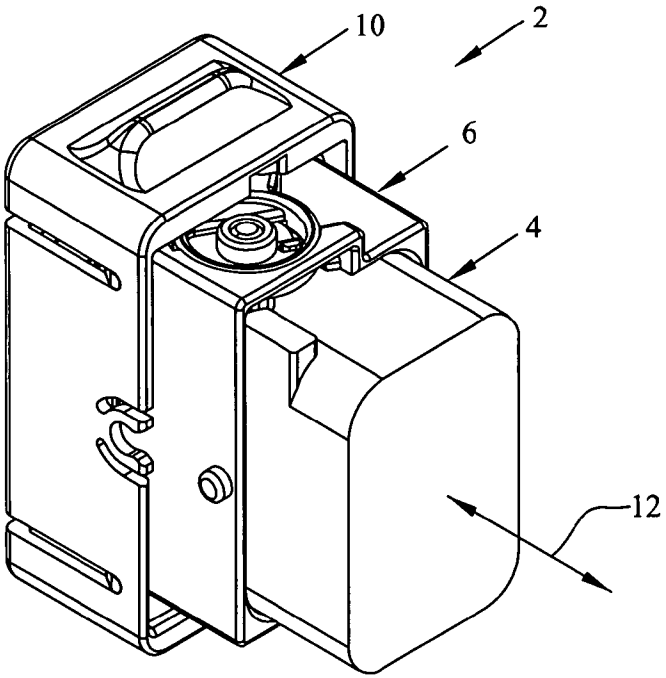
FIG. 1 is a front perspective view of the electrical connector assembly of the present invention.
Figure 3:
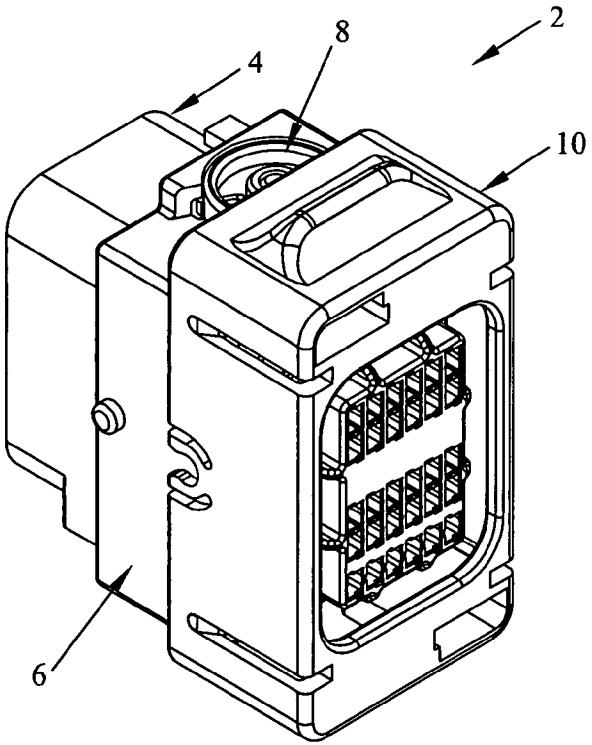
FIG. 3 is a rear perspective view of the electrical connector assembly of FIG. 1 from the opposite side thereof.
Figure 4:
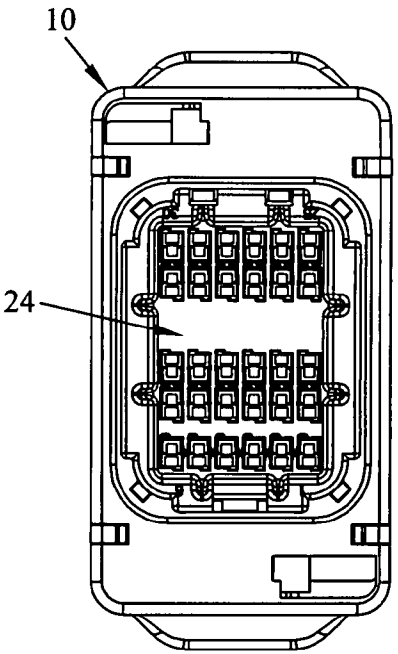
FIG. 4 is a rear plan view of the assembly of FIG. 3.

With reference first to FIGS. 1-4, a connector assembly is shown at 2 which is mateable to a mating connector 4. Mating connector 4 could be connected to a harness of wires, or could be an electronic device, such as a control module, and therefore is shown somewhat diagrammatically and only the outer periphery (mating interface) will be described herein. Connector assembly 2 is comprised of a connector housing 6, a rotary mating assist member 8, and a linear actuator member 10. As will be discussed further herein, and with reference to FIG. 1, it should be appreciated that linear actuator member 10 is moveable relative to connector housing 6, along the same axis that mating connector 4 interconnects with connector assembly 2, that is along mating axis 12.

Figure 5:
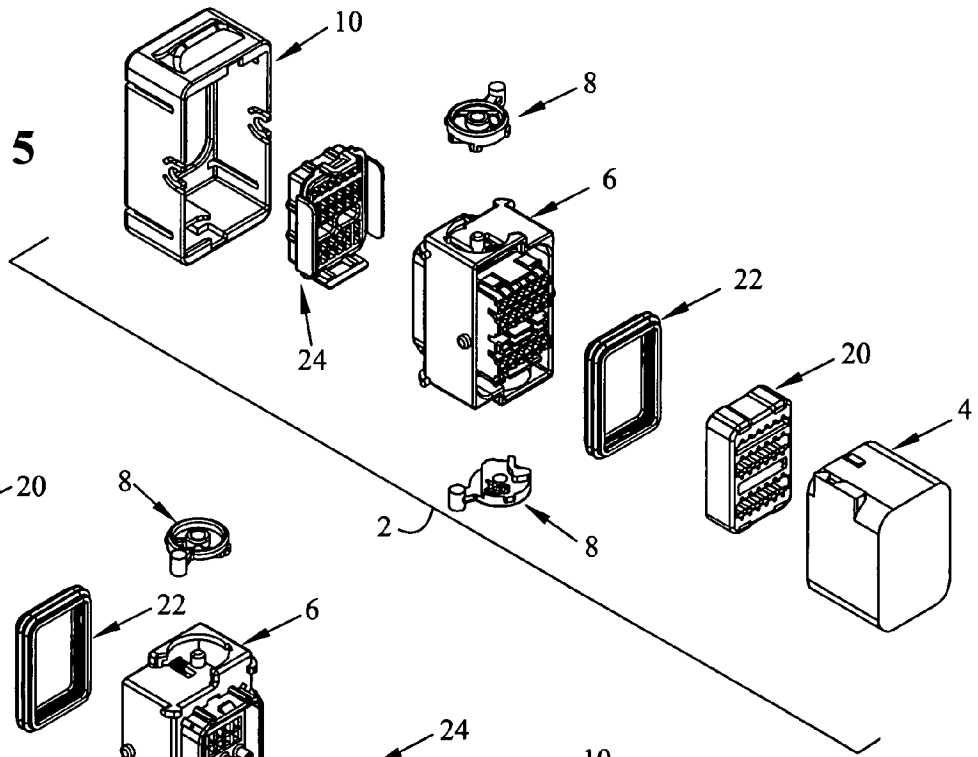
FIG. 5 is an exploded view of the perspective view as assembled in FIG. 1.
Figure 6:
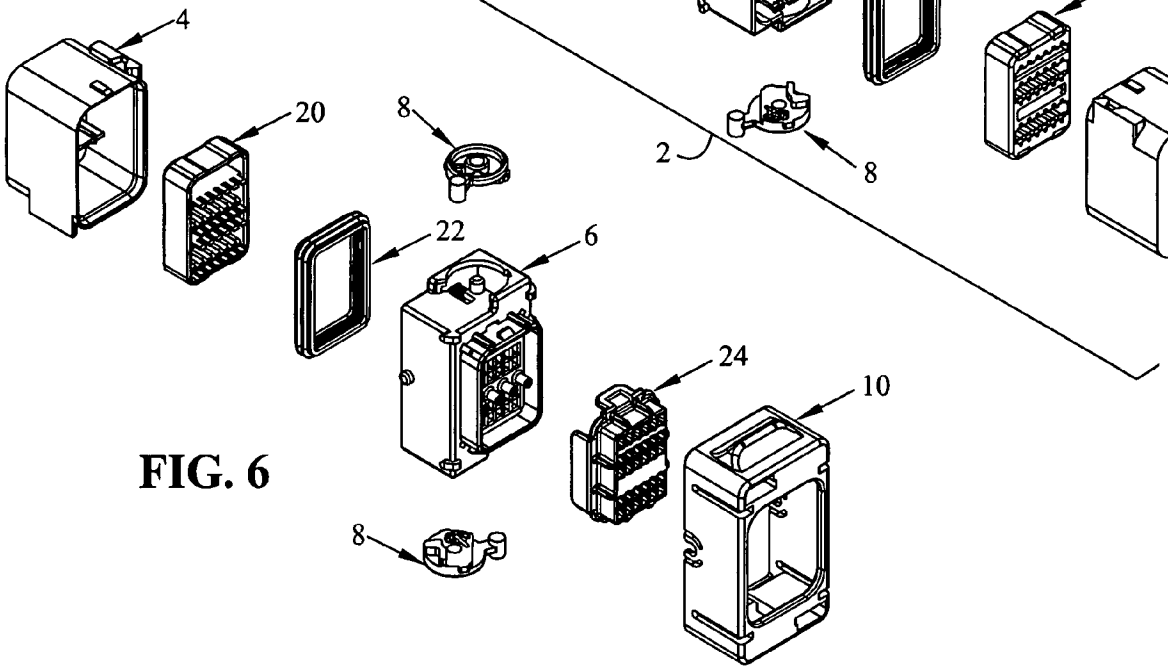
FIG. 6 is an exploded view of the perspective view as assembled in FIG. 3.

With reference now to FIGS. 5 and 6, the connector assembly 2 and the mating connector 4 are shown in an exploded manner where the connector assembly 2 further comprises a terminal position assurance member (TPA) 20, a seal 22, and a rear plate 24. With reference now to FIGS. 7-10, connector housing 6 will be described in greater detail.

As shown, connector housing 6 includes side walls 30 having locking lugs 32 and guiding projections 34 positioned thereon. Each of the upper and lower end walls 40 is comprised of wall portion 42 and raised wall portion 44. Raised wall portion is connected at one side to side wall 30 and at the opposite side to wall portion 42 by way of edge wall 50 and edge front 52 (FIG. 9). Side walls 30, top wall portions 42 and raised wall portions 44 define an external shroud about an inner wall 54 (FIG. 10) in which are provided a plurality of terminal receiving cavities 56 for receiving contacts or terminals of the electrical connector. Wall portion 42 is discontinuous in that it does not extend entirely between both side walls 30. The difference in height between the wall portions 42 and 44 on both the upper and lower end walls 40 of housing 6 (together with the discontinuity) defines an internal opening at 58 (FIGS. 8 and 10) as described further herein.

Figure 8:
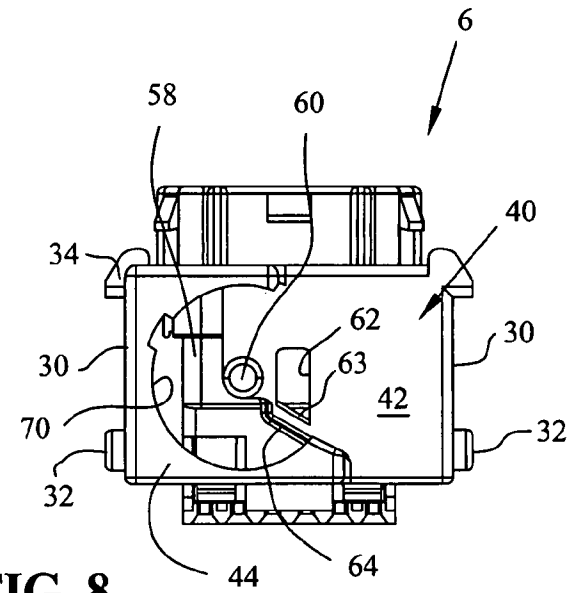
FIG. 8 is a top plan view of the connector housing of FIG. 7.
Figure 7:
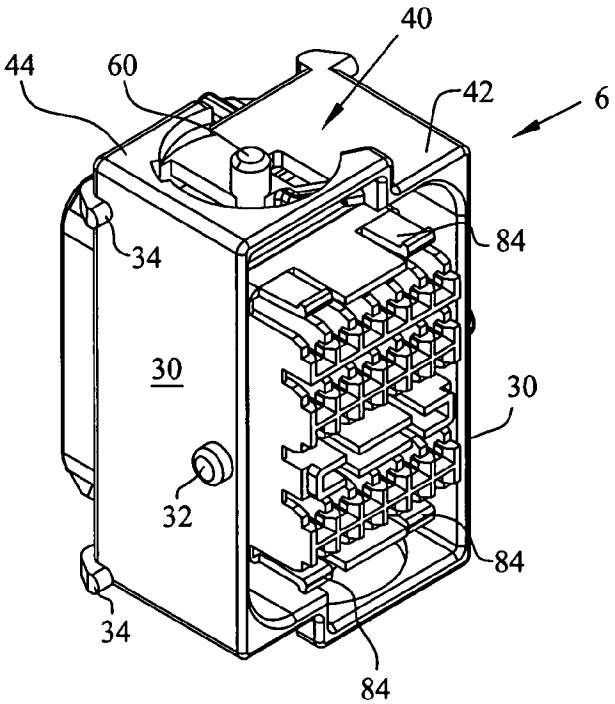
FIG. 7 is a front perspective view of the connector housing.
Figure 9:
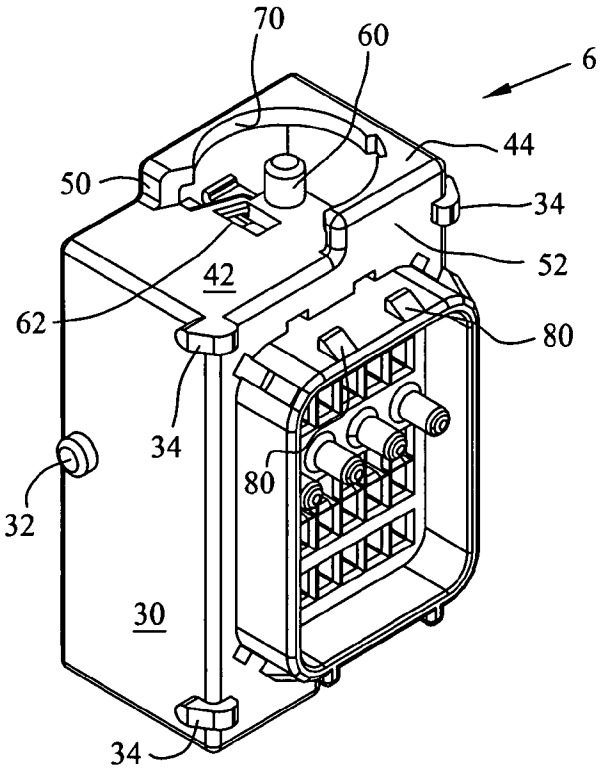
FIG. 9 is a rear perspective view of the connector housing of FIG. 7.

With reference now to FIGS. 7-9, wall portion 42 includes a mounting shaft 60 integrally molded therewith, a latching aperture 62 having a beveled edge 63 (FIG. 8), and a front edge at 64 (FIG. 8). Raised wall portion 44 includes a circular-shaped opening at 70 which as shown in FIG. 8 accesses wall portion 42, as well as opening 58 from above. Finally with respect to FIG. 9, housing 6 includes latches 80 for latching with rear plate 24 (FIG. 5), and as shown in FIG. 7, housing 6 has latching arms 84 for retaining TPA 20 (FIG. 5).

Figure 12:
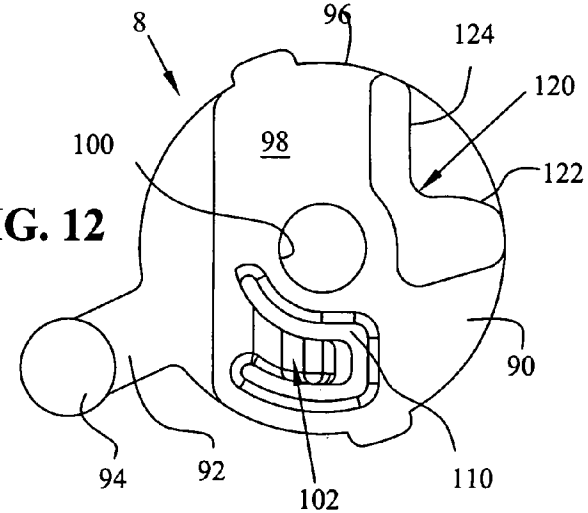
FIG. 12 is an inner plan view of the rotary mating assist member of FIG. 11.
Figure 11:
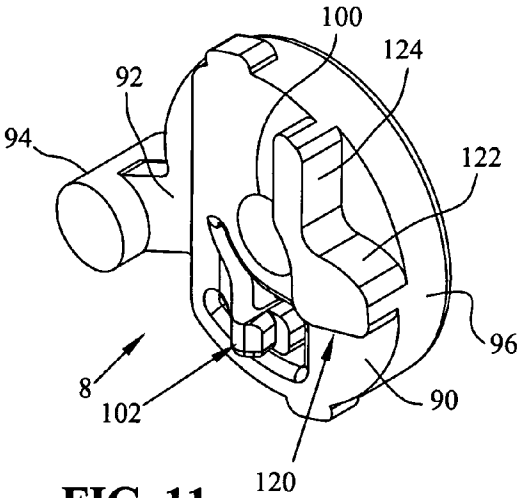
FIG. 11 is an inner perspective view of the rotary mating assist member.
Figure 13:
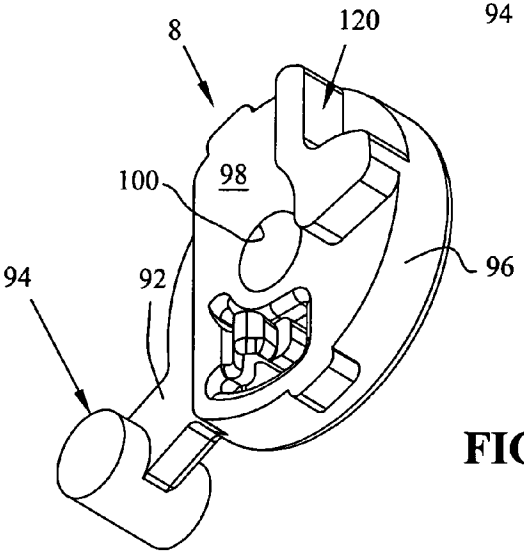
FIG. 13 is another view of the rotary mating assist member from a different perspective.
Figure 14:
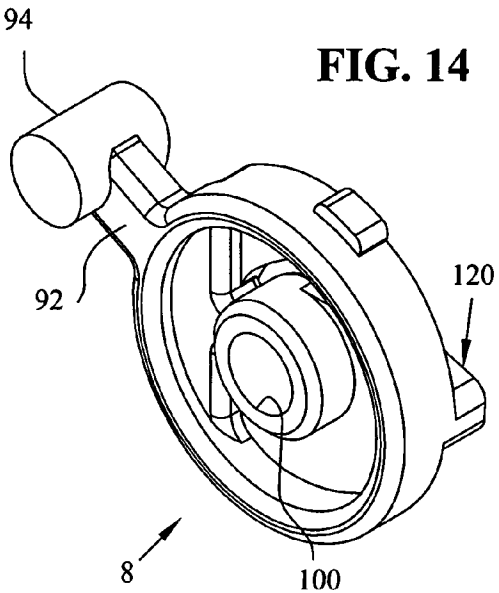
FIG. 14 is outer perspective view of the rotary mating assist member.
Figure 15:
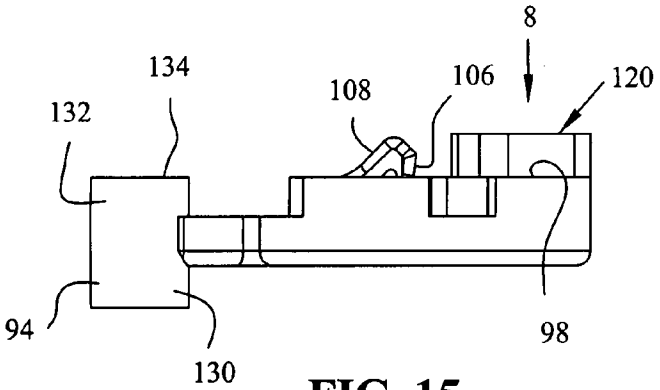
FIG. 15 is a side plan view of the rotary mating assist member.
Figure 16:
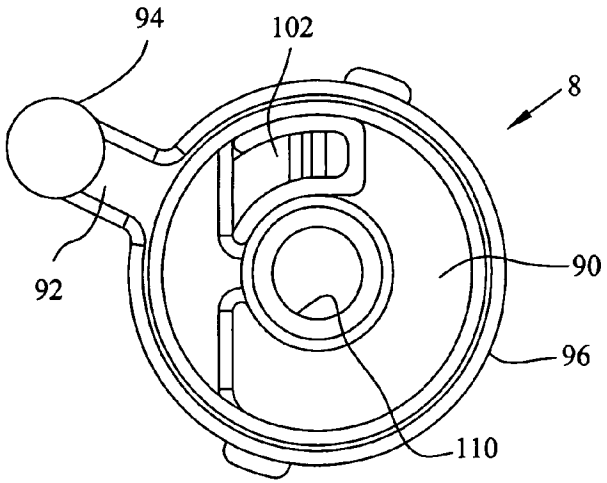
FIG. 16 is an outer plan view of the rotary mating assist member.

With respect now to FIGS. 11-16, rotary mating assist member 8 will be described in greater detail. As shown in the figures, rotary mating assist member 8 includes a central hub portion 90 having a lever crank at 92 and a contact member in the form of a contact bar 94 integrally attached thereto. The central hub portion 90 includes an outer diameter portion at 96, a bearing surface 98 with an aperture 100 therethrough. Central hub portion 90 also includes a latch at 102 (FIGS. 11 and 12) having a foot portion 104, and as best shown in FIG. 15, a forwardly angled stop surface 106 and a ramped surface 108. Latch 102 is resiliently mounted to the central hub portion 90 by way of an opening 110 (FIG. 12) surrounding latch 102. As shown in FIGS. 11 and 12, central hub portion 90 further includes a gear member 120 having gear surfaces 122 and 124 as described in further detail. As shown best in FIG. 15, contact bar 94 includes contact members 130 and 132. Contact bar 94 further includes a bearing surface 134 which is coplanar with bearing surface 98 of central hub portion 90.

Figure 17:
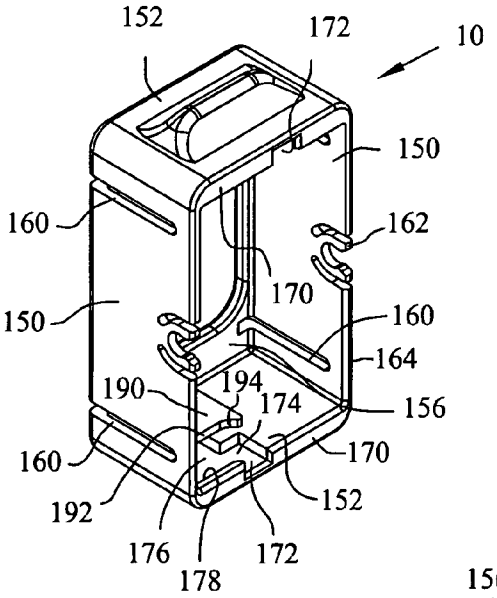
FIGS. 17-18 are rear perspective views of the linear actuator member.
Figure 18:
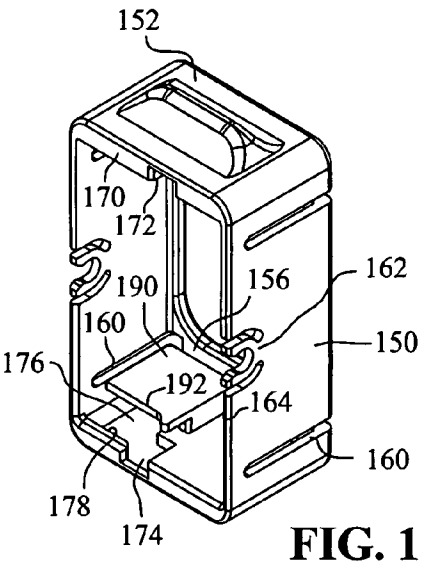
Figure 19:
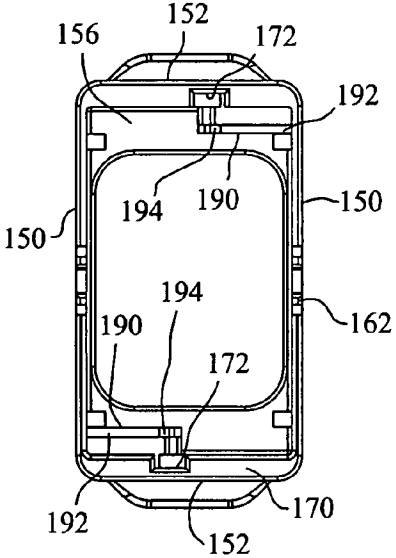
FIG. 19 is a rear plan view of the linear actuator.

With reference now to FIGS. 17-19, linear actuator member 10 will be described in greater detail. Linear actuator member 10 is comprised of side walls 150, end walls 152, and a partial back wall at 156. Side walls 150 include slots 160 which extend entirely therethrough, and into the interior of the linear actuator member 10, as best shown in FIGS. 17 and 18. Side walls 150 also include latch members 162 which extend from a front edge 164. End walls 152 define a front edge 170 having a slot 172 therethrough. Slot 172 defines a linear channel portion 174 and a lateral channel portion at 176, within end walls 152. As shown best in FIGS. 17 and 18, lateral channel portion 176 defines an inner edge or contact surface at 178 behind front edge 170. Finally, as shown best in FIGS. 17-19, a contact member camming wall 190 extends from back wall 156 and includes a front contact surface 192 which includes a radiused surface at 194.

Figure 21:
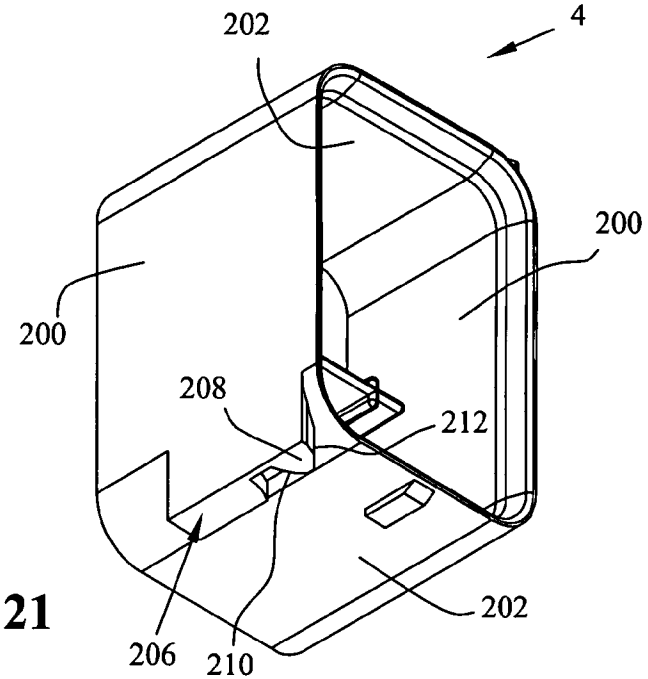
FIGS. 20 and 21 show upper and lower perspective views respectively of the outer profile of a mating connector.
Figure 20:
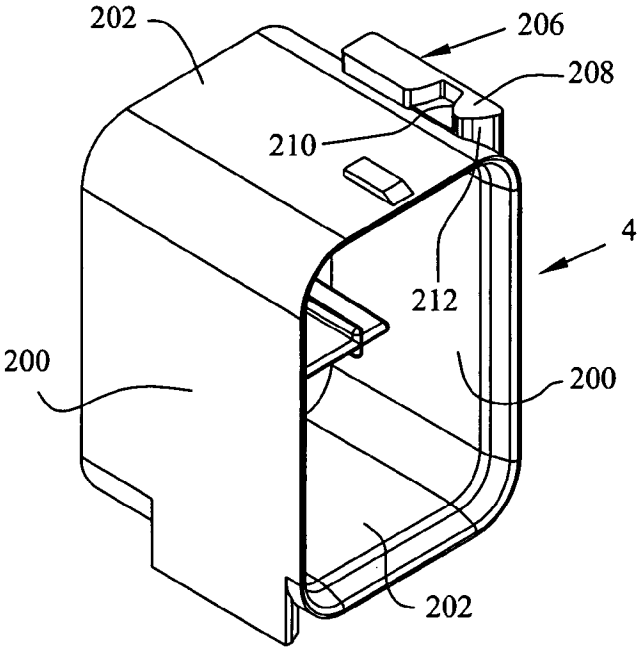

With reference now to FIGS. 20 and 21, the profile of mating connector 4 will be described in greater detail. Mating connector has side walls 200 and end walls 202. A gearing mechanism 206 is positioned on diametrically opposite corners and includes a gear tooth 208 having teeth surfaces 210 and 212 as described herein. With the components as described above, the assembly and operation of the connector assembly 2 will now be described.

Figure 10:
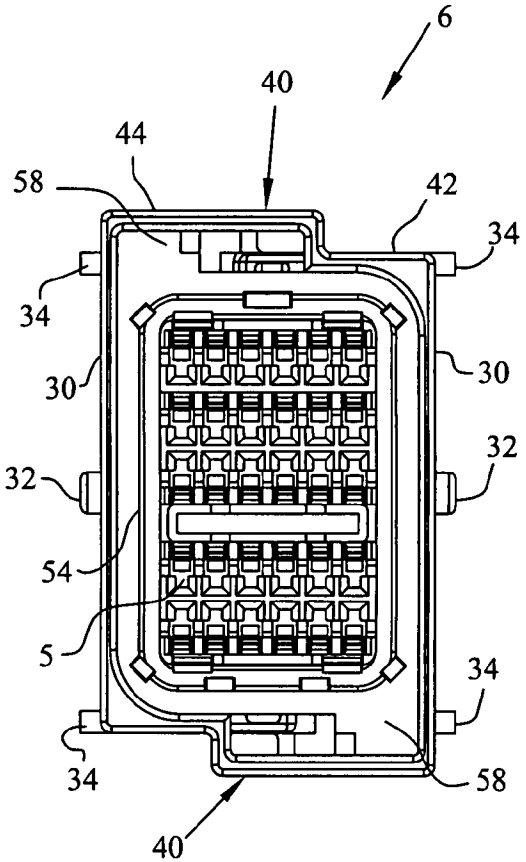
FIG. 10 is a front plan view of the connector of FIG. 9.
Figure 22:
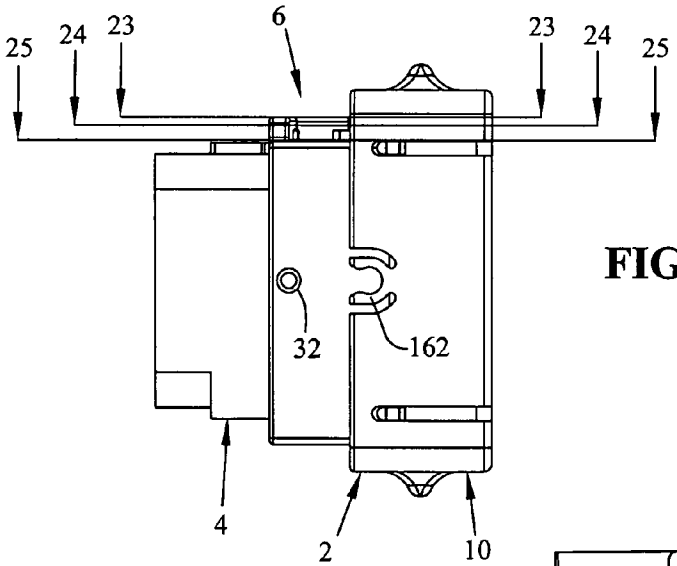
FIG. 22 shows a side plan view of the connector assembly with the mating connector positioned within the connector assembly, prior to movement of the linear actuator member.

Electrical connector 2 is assembled into the configuration shown in FIG. 22 by positioning seal 22 (FIGS. 5 and 6) within connector housing 6 and by latching TPA 20 and rear plate 24 to connector housing 6. The rotary mating assist members 8 may now be positioned to fit within the corresponding openings 70 (FIG. 8) and with aperture 100 (FIG. 16) positioned over mounting shaft 60 (FIGS. 7-8). The rotary mating assist member 8 is positioned such that bearing surface 98 (FIG. 12) sits flush against wall portion 42. Contact bar 94 is also positioned such that surface bearing 134 is positioned against the outer surface of wall portion 42 (FIG. 8) and with gear member 120 positioned within internal opening 58 (FIG. 10). It should be appreciated from the above description that there are two rotary mating assist members 8, positioned in diametrically opposite positions of connector housing 6. During the description of the operation, only one such rotary mating assist member 8 will be described, although it should be understood that the rotary mating assist members 8 operate in a mirror image fashion.

Figure 23:
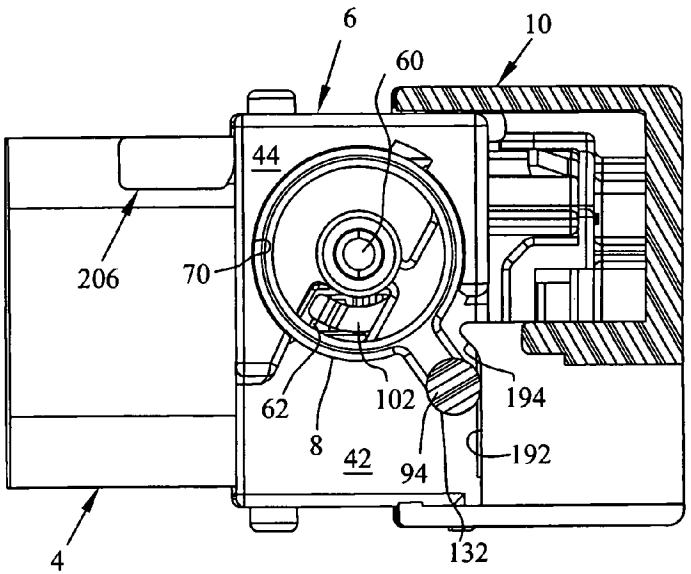
FIG. 23 is a cross-sectional view through lines 23-23 of FIG. 22.

Linear actuator member 10 may now be assembled to housing 6 by positioning guiding projections 34 within slots 160 and by positioning contact bar 94 through slot 172, through linear channel portion 174 and into lateral channel portion 176. This will position first contact surface 130 of contact bar 94 within lateral channel portion 176 and adjacent to rear edge 178 (FIG. 18); and position second contact surface 132 adjacent to contact surface 192 and radiused contact surface 194, which is best shown in FIG. 23. Contact bar 94 will translate within lateral channel portion 176 between rear edge 178 and contact surface 192, depending upon whether the linear actuator member 10 is being pushed or pulled. It should also be noted at this point that the latch 102 of the rotary mating assist member 8 is positioned within its corresponding latching aperture 62 with foot portion 104 overlapping beveled edge 63 which retains the rotary mating assist member 8 in a fixed position, as best shown in FIG. 23. In this fixed position, the connector assembly 2 is profiled to receive the mating connector 4 as described herein.

Figure 24:
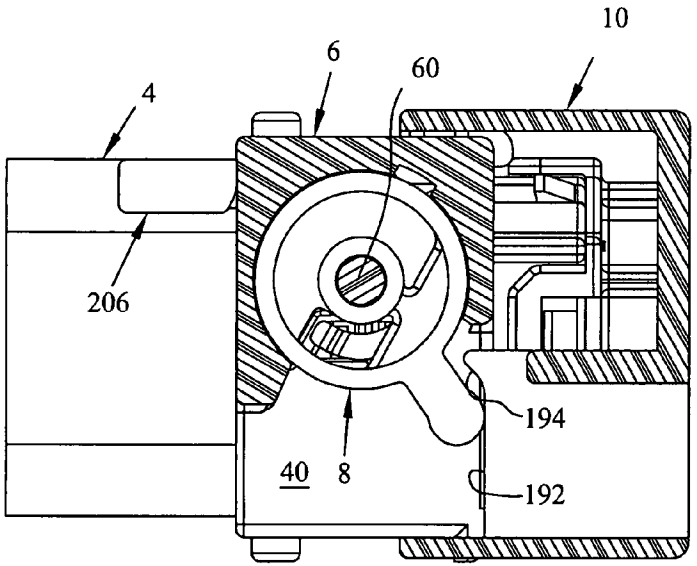
FIG. 24 is a cross-sectional view through lines 24-24 of FIG. 22.
Figure 25:
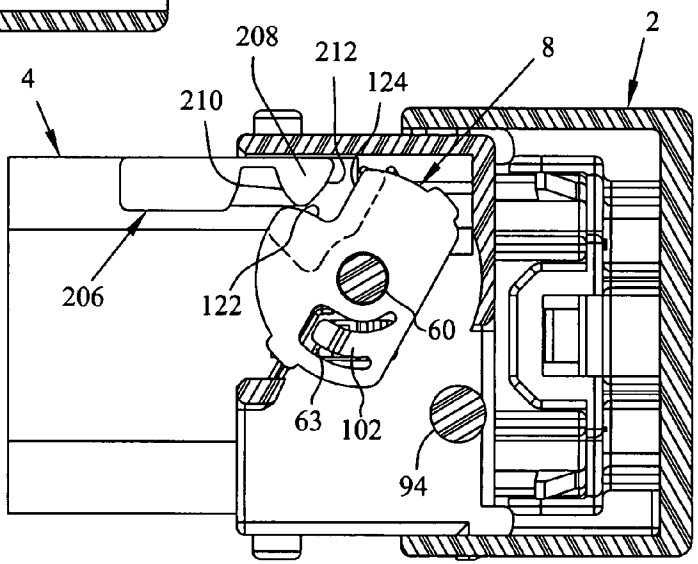
FIG. 25 is a cross-sectional view through lines 25-25 of FIG. 22.
Figure 26:
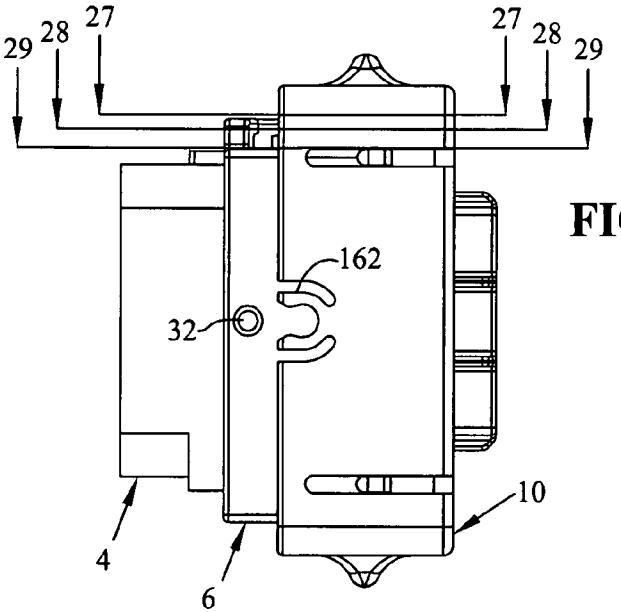
FIG. 26 is a side plan view similar to that of FIG. 22, showing the linear actuator moved into an intermediate position relative to the connector housing.

With reference now to FIGS. 24 and 25, rotary mating assist member 8 is shown in a pre-latched position such that mating connector 4 may be received into the connector assembly 2. Rotary mating assist member is shown latched in FIGS. 23 and 24, with latch 102 positioned in latching aperture 62, and with foot portion 104 overlying beveled edge 63.

In this position, gear tooth 208 may be received between the gear surfaces 122 and 124, as best shown in FIG. 25.

Figure 27:
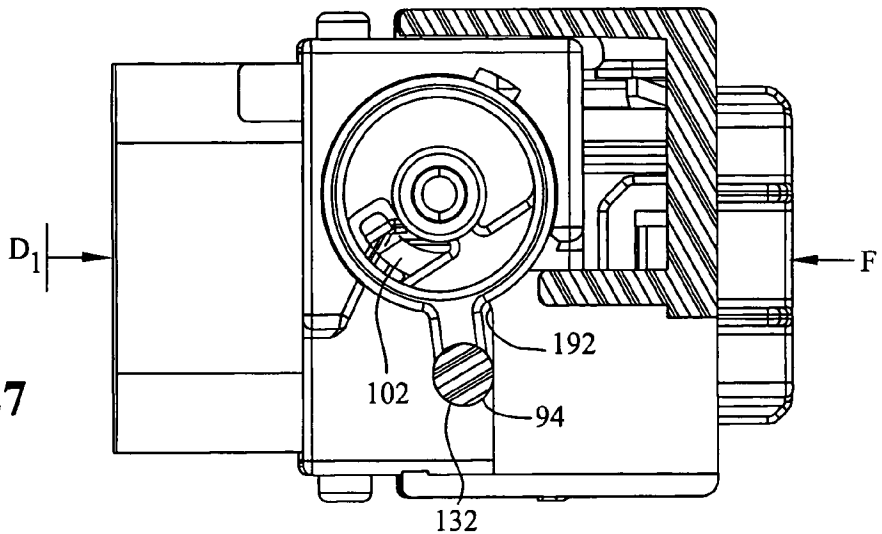
FIG. 27 is a cross-sectional view through lines 27-27 of FIG. 26.
Figure 28:
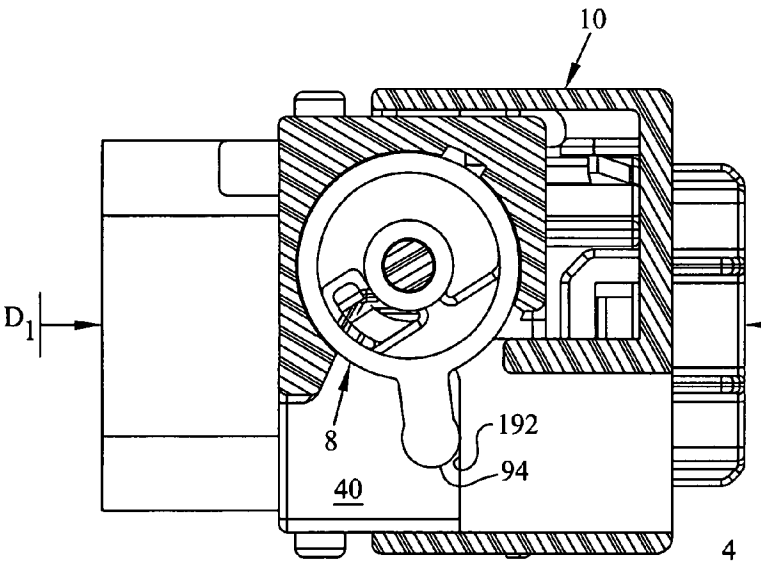
FIG. 28 is a cross-sectional view through lines 28-28 of FIG. 26.
Figure 29:
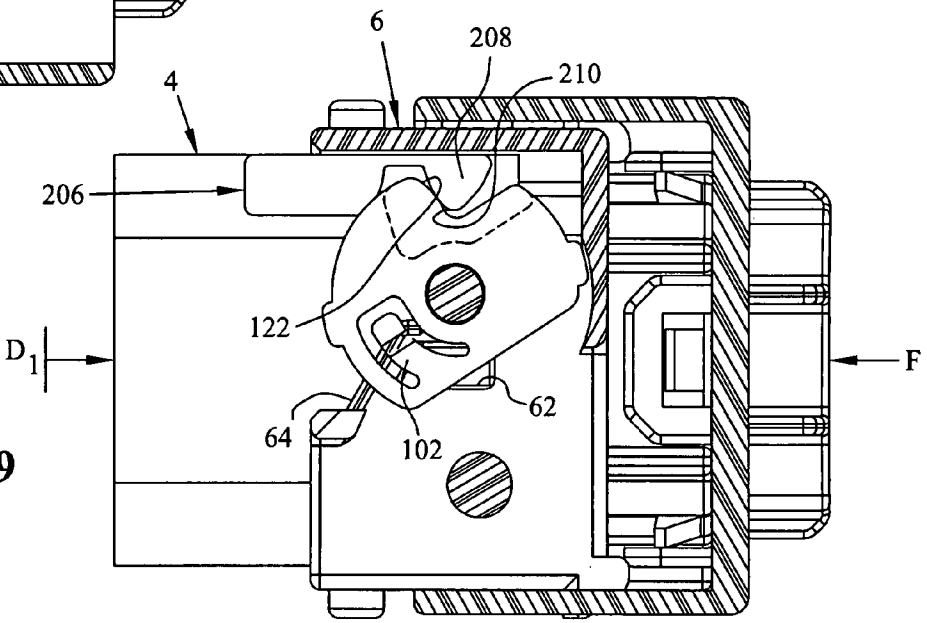
FIG. 29 is a cross-sectional view through lines 29-29 of FIG. 26.
Figure 30:
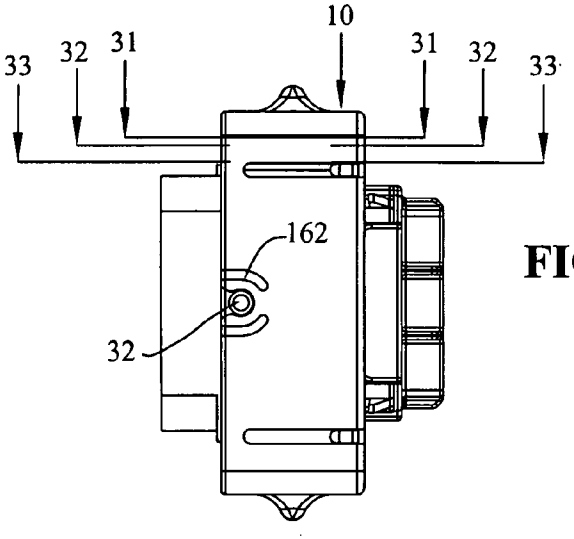
FIG. 30 is a side plan view similar to that of FIG. 26 showing the linear actuator in the fully actuated position.
Figure 31:
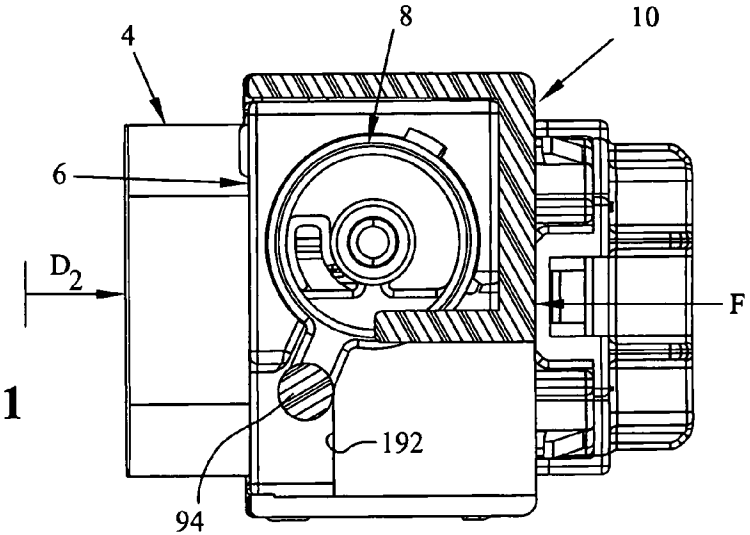
FIG. 31 is a cross-sectional view through lines 31-31 of FIG. 30.
Figure 32:
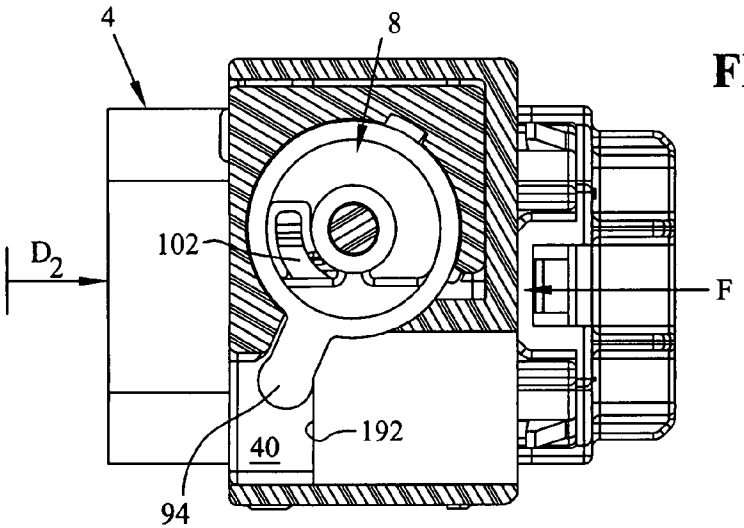
FIG. 32 is a cross-sectional view through lines 32-32 of FIG. 30.

Once mating connector 4 is positioned as shown in FIG. 25, a force F as shown in FIGS. 27-29 may be applied to linear actuator member 10 causing mating connector 4 to be drawn into connector housing 6 by a distance $D_1$. As shown in FIGS. 27 and 28, linear actuator member 10 is moved inwardly and rotary mating assist member 8 is shown rotated with surface 132 of contact bar 94 sliding along contact surface 192. As also shown in FIGS. 27-29, latch member 102 has now moved out of its corresponding latching aperture 62, under the influence of the torque on rotary mating assist member 8 and the angled stop surface 106 (FIG. 15) applied against beveled edge 63, and thereafter progresses towards front edge 64 (FIG. 29). At this point, gear teeth surfaces 122 and 210 are in meshing engagement (FIG. 29) which causes mating connector 4 to be drawn or pulled into connector housing 6.

Finally with respect to FIGS. 30-33, linear actuator member 10 is shown in the fully locked position with latch members 162 in latch engagement with locking lugs 32. With respect to FIGS. 31-33, the rotary mating assist member 8 is now rotated to its full clockwise position, with mating connector 4 drawn into connector housing 6 by a distance $D_2$.

Figure 33:
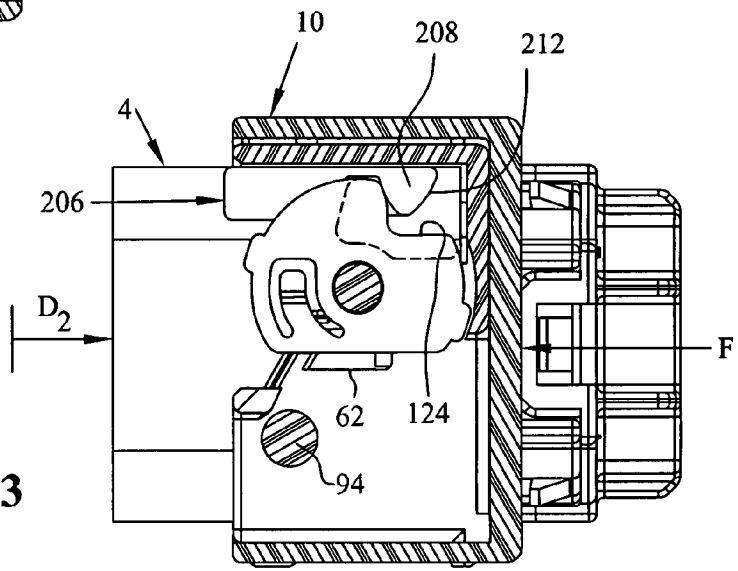
FIG. 33 is a cross-sectional view through lines 33-33 of FIG. 30.

It should also be understood that disconnection of the connector assembly 2 from the corresponding mating connector 4 would be a reverse process from that described above. For example, a pulling force on linear actuator member 10 from the position of FIG. 33 causes inner edge 178 (FIGS. 17 and 18) to pull contact bar 94 in the opposite direction until such time as surfaces 124 and 212 engage (FIG. 33). Continued rearward movement of linear actuator member 10 causes a counter rotation of rotary assist member 8 which in turn retracts mating connector 4 back to the position shown in FIG. 25. Latch 102 also snaps back into its locked position in aperture 62, after ramped surface 108 (FIG. 15) assists latch over edge 64.

What is claimed is:

1. An electrical connector assembly, comprising:

a housing for mating with a mating connector along a mating axis, the housing having at least one terminal receiving cavity extending therethrough;

a mating assist member operatively connected to the housing; and an actuator member, being movable relative to the mating assist members and the housing and causing movement of the mating assist member, upon movement of the actuator member relative to the housing along the mating axis, wherein each mating assist member is comprised of a rotary mating assist member, and the rotary mating assist member has gear teeth which cooperate with gear teeth on the mating connector, and each rotary mating assist member further comprises a lever connected to the rotary member at one end thereof, and having a contact member at the opposite end of the lever, and the actuator member comprises a first contact surface, whereby upon linear movement of the actuator member, the first contact surface engages the contact member, rotating the rotary mating assist member.

2. The electrical connector assembly of claim 1, wherein the actuator member is comprised of a lateral channel bounded by the first contact surface and a second contact surface, whereby linear movement of the actuator member causes contact between either of the first and second contact surfaces and the contact member of the rotary mating assist member with resultant rotation of the rotary mating assist member.

3. The electrical connector assembly of claim 2, wherein the actuator member comprises sidewalls and end walls, and a slot through the end walls thereof defining a linear channel which intersects the lateral channel.

4. The electrical connector assembly of claim 1, wherein the housing includes an end wall upon which the rotary mating assist member, rotates.

5. The electrical connector assembly of claim 4, wherein the end wall is discontinuous along at least one side thereof defining an internal opening.

6. The electrical connector assembly of claim 5, wherein the gear teeth of the rotary mating assist member are positioned along the peripheral edge of the rotary mating assist member, and are positioned within the internal opening.

7. The electrical connector assembly of claim 6, further comprising a raised wall portion positioned in a spaced relation to the end wall, which is profiled to receive therethrough, the rotary mating assist member.

8. An electrical connector assembly, comprising:

a housing for mating with a mating connector along a mating axis, the housing having at least one terminal receiving cavity extending therethrough, the housing having a mating assist member operatively connected to the housing, where the mating assist member is comprised of a rotary mating assist member having a lever crank attached thereto and the mating assist member includes at least one gear tooth; and an actuator member, movable relative to the housing along the mating axis, and being interengagingly cooperable with the mating assist member, thereby moving the at least one gear tooth upon movement of the actuator member;

wherein the lever crank has a contact member, and the actuator member comprises a first contact surface, whereby upon linear movement of the actuator member, the first contact surface engages the contact member, which rotates the rotary member.

9. The electrical connector assembly of claim 8, wherein the actuator member comprises a lateral channel bounded by the first contact surface and a second contact surface, whereby linear movement of the actuator member causes contact between the first and second contact surfaces and resultant rotation of the rotary mating assist member.

10. The electrical connector assembly of claim 9, wherein the actuator member comprises sidewalls and end walls, and a slot through each of the end walls thereof defining a linear channel which intersects the lateral channel.

11. The electrical connector assembly of claim 8, wherein the housing includes an end wall upon which the rotary mating assist member rotates.

12. The electrical connector assembly of claim 11, wherein the end wall is discontinuous along at least one side thereof defining an internal opening.

13. The electrical connector assembly of claim 12, wherein the at least one gear tooth of the rotary mating assist member is positioned along the peripheral edge of the rotary mating assist member, and is positioned within the internal opening.

14. The electrical connector assembly of claim 13, further comprising a raised wall portion positioned in a spaced relation to the end wall, and is profiled to receive therethrough, the rotary mating assist member.

15. An electrical connector assembly, comprising:

a housing for mating with a mating connector along a mating axis, the housing having at least one terminal receiving cavity extending therethrough, the housing having a mating assist member operatively connected to the housing, the housing including an end wall upon which the rotary mating assist member rotates and the end wall is discontinuous along at least one side thereof defining an internal opening, the mating assist member is comprised of a rotary mating assist member having a lever crank attached thereto and includes at least one gear tooth; and an actuator member, movable relative to the housing along the mating axis, and being interengagingly cooperable with the mating assist member, thereby moving the at least one gear tooth upon movement of the actuator member;

wherein the at least one gear tooth of the rotary mating assist member is positioned along the peripheral edge of the rotary mating assist member, and is positioned within the internal opening.

16. The electrical connector assembly of claim 15, further comprising a raised wall portion positioned in a spaced relation to the end wall, and is profiled to receive therethrough, the rotary mating assist member.

* * * * *